United States Patent [19]

Skinner et al.

[11] 4,346,761

[45] Aug. 31, 1982

[54] HYDRA-JET SLOTTING TOOL

[75] Inventors: Neal G. Skinner; Harry A. Braswell, both of Duncan, Okla.

[73] Assignee: Halliburton Company, Duncan, Okla.

[21] Appl. No.: 124,009

[22] Filed: Feb. 25, 1980

[51] Int. Cl.[3] ..... E21B 29/00

[52] U.S. Cl. ..... 166/206; 166/222; 166/55.1; 166/298

[58] Field of Search ..... 175/94, 321, 67, 297; 166/222, 223, 55.1, 798, 55, 98, 298; 92/8, 143

[56] References Cited

U.S. PATENT DOCUMENTS

| | | | |
|---|---|---|---|
| 2,034,768 | 3/1936 | O'Neill | 166/298 |
| 2,624,409 | 1/1953 | O'Neill | 166/223 |
| 2,806,514 | 9/1957 | Potts | 166/98 |
| 2,961,048 | 11/1966 | Davis, Sr. | 166/98 X |
| 2,965,175 | 12/1960 | Ransom | 166/98 |
| 2,978,030 | 4/1961 | Green | 166/98 |
| 3,266,571 | 8/1966 | St. John et al. | 166/223 |
| 3,280,913 | 10/1966 | Smith | 166/298 |
| 3,827,512 | 8/1974 | Edmond | 175/94 |
| 4,134,453 | 1/1979 | Love | 166/298 |
| 4,161,224 | 7/1979 | Hostrap | 175/297 |

*Primary Examiner*—William F. Pate, III

*Attorney, Agent, or Firm*—Joseph A. Walkowski; John H. Tregoning

[57] ABSTRACT

The present invention relates to an apparatus for controlling the rate and extent of cutting slots in flow conductors, particularly casing in wells. The apparatus is hung in the well from a pipe string, locked in position, and force applied to the string. A hydraulic metering mechanism acts against the applied force to control the rate of travel of one or more jet bodies attached to the movable mandrel of the apparatus, the stroke of which determines the extent of the cut.

48 Claims, 12 Drawing Figures

HYDRA-JET SLOTTING TOOL

In practically all types of wells, including oil and gas wells, water wells, and those for solution mining, it is common practice to insert a pipe or flow conductor in the well bore, and in many instances cement the conductor in place by pumping cement into the flow conductor and out of its lower end to its exterior, where the cement is allowed to set and secure the flow conductor in the well bore. The type of flow conductor, generally referred to as "casing," depends on the type of well. For example, in gas and oil wells and in some water wells, the casing is made up of iron and steel pipe joints. In other water wells and in solution mining wells, where minerals such as uranium, sulfur, copper and nickel are washed or leached from earth formations, the casing may be nonmetallic, formed of a polyvinyl chloride composition or glass reinforced thermosetting epoxy resin material. In all of these wells, however, it is necessary to provide perforations which may be round holes or elongated slots in the casing and through the surrounding cement to permit fluid communication between the well bore and adjacent earth formation, making flow to and/or from the well bore possible. In the instances of solution mining, as well as in some petroleum wells, both injection and producing wells are employed, the casing in both being perforated or slotted.

Some types of apparatus and methods of perforating well casing involve using explosive charges. However, while such a method is convenient, the jets of hot gaseous material produced by detonation of the explosive charges tend, in many instances, to cause damage to the formation adjacent the casing. Furthermore, if the casing is of a polyvinyl chloride material or glass fiber reinforced thermosetting epoxy resin material, the temperatures generated by the explosive charges cause the material of the casing to plasticize and flow, at least partially closing the perforations formed, thus blocking flow between the well bore and formation. In the case of glass fiber reinforced thermosetting epoxy resin casing, an explosive charge usually shatters the casing, which also delaminates from the temperatures generated.

So-called abrasive jetting, which involves pumping an abrasive-laden fluid jet against the casing, thereby cutting a hole or slot, has been one solution to the problems associated with explosive charge perforating. Apparatus for this type of operation are well known; U.S. Pat. No. 3,145,776 issued to Forrest C. Pittman on Aug. 25, 1964 and assigned to Halliburton Company, discloses a type of jet body employed to create an abrasive fluid stream. U.S. Pat. No. 4,050,529 discloses another such jet body. Abrasive fluid is pumped down the pipe string to the jet body directed against the inside of the casing by a nozzle, and returns of the fluid along with debris from the casing and formation are taken up the well bore annulus. A primary drawback to the utilization of abrasive jetting, however, has been one of longitudinal control of the jet nozzle in the well bore. When drill pipe or tubing is employed to direct fluid to the jet body in a slotting operation, the method of moving the jet of fluid consists of moving the pipe or tubing string up and down at the surface and surmising that the movement of the jet downhole corresponds to this motion. In deep holes, where there is a great deal of stretch in the string, and in highly deviated holes, where the string has a tendency to "hang-up" against the inside of the casing, an assumption that the jet is being properly directed is generally in error. One method and apparatus for jet control is disclosed in U.S. Pat. No. 2,303,976: a screw-type mandrel is provided to move the jet nozzle from one longitudinal position to another, but there is no provision for maintaining the nozzle in a straight path as it rises or descends with respect to the casing, hence a slotting operation cannot be performed, but only the cutting of individual perforations at various levels. Another proposed solution to the control problem is disclosed in U.S. Pat. No. 4,134,453, issued to Love et al on Jan. 16, 1979 and assigned to Halliburton Company; a jet nozzle head is connected to a string of continuous tubing which is fed from a reel into the well bore. As there are no tubing joints, there is less of a tendency to hang-up in the well bore, and better control of the stroke of the jet nozzle is effected due to the continuous nature of the tubing and its ability to be reel-fed. However, the depth to which such an apparatus may be run is obviously restricted by the size of the reel which can be used, and by the strength of the tubing, necessarily limited by its ductility. Furthermore, in deviated holes, the reciprocating stroke of the tubing employed in slotting operations may cause it to buckle if there is too much contact with the casing wall, or the stroke is made too long. Moreover, there is also the inconvenience with this apparatus, under most conditions, of making a number of passes to slot the casing and cement and jet into the formation.

In accordance with the present invention, a jet body is attached to a tubing or pipe string by a control mechanism, hereafter referred to as a slotting assembly. The jet body may be any of a number of well known types, with circumferentially spaced nozzles every 120°, 90°, 180° or in whatever arrangement is desired. The jet body is attached to a mandrel longitudinally slidably disposed in the housing of the slotting assembly, the travel of the mandrel corresponding to the length of the slot to be cut in the casing. The slotting assembly is mechanically anchored by slips in the casing at the desired location, and a predetermined amount of weight is set down on the anchored slotting assembly through the mandrel as abrasive fluid is pumped down the pipe string. The rate of travel of the mandrel with respect to the anchor position of the slotting assembly is determined by metering hydraulic fluid from one chamber in the housing to another. When the mandrel reaches the extent of its travel, a slot (or slots, one for each jet nozzle) having been cut in a single pass thereby, the pipe string is picked up, which releases the anchoring slips, and the weight of the released outside case of the slotting assembly in conjunction with a restorative spring will move to "pull" the mandrel back to its original position. The slotting assembly is then ready to be repositioned in the casing for another pass. Several jet bodies can be attached in series to the end of the mandrel, to cut slots at various levels during the same pass, and the slotting assembly can be "jumped" down the casing in intervals less than or equal to the travel of the mandrel so that elongated slots may be formed by connecting a number of slots cut during consecutive passes. It can readily be seen that the disadvantages with respect to jetting control experienced in the prior art devices are eliminated by the slotting assembly of the present invention. The positioning of the tool is exact, and all that is required to initiate the travel of the jet body is application of weight to the pipe string, the length of slot being predetermined as well as the pressure applied and abrasive mixture utilized. There is no depth limitation with the present invention, nor is there a problem of limited tubing strength as with continuous tubing. The necessity for storing a separate inventory of continuous tubing is eliminated as conventional surface equipment is employed with a pipe string in practicing the present invention, also avoiding the bulkiness of a reel unit for the tubing. Moreover, the release procedure and automatic reset of the slotting assembly is extremely simple and easily lends itself to multiple or extended slotting procedures.

The foregoing advantages and preferred embodiments of the invention will be better understood from the following description taken in conjunction with the accompanying drawings wherein.

Figure 1A:
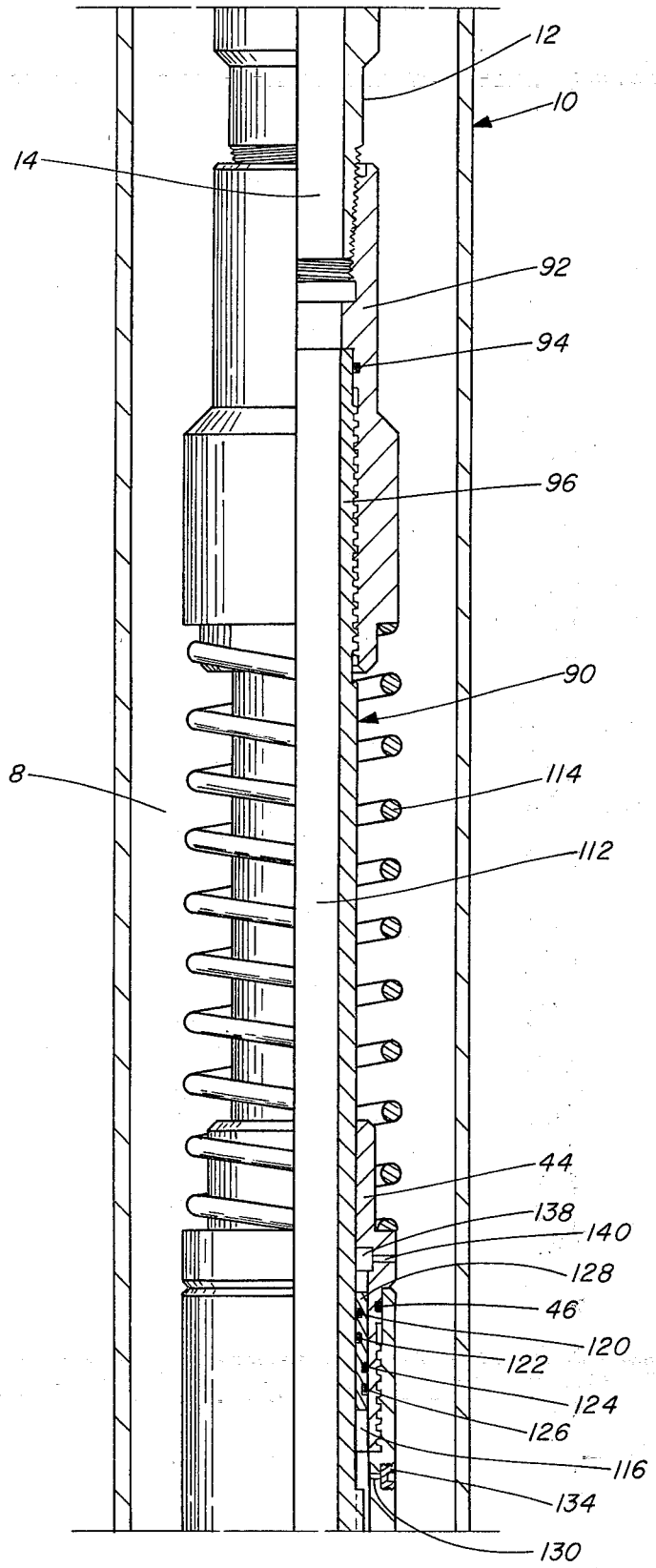
FIGS. 1A through 1D are vertical half-sectional elevations showing the slotting assembly of the present invention with attached jet body suspended in a well casing prior to slotting.
Figure 1B:
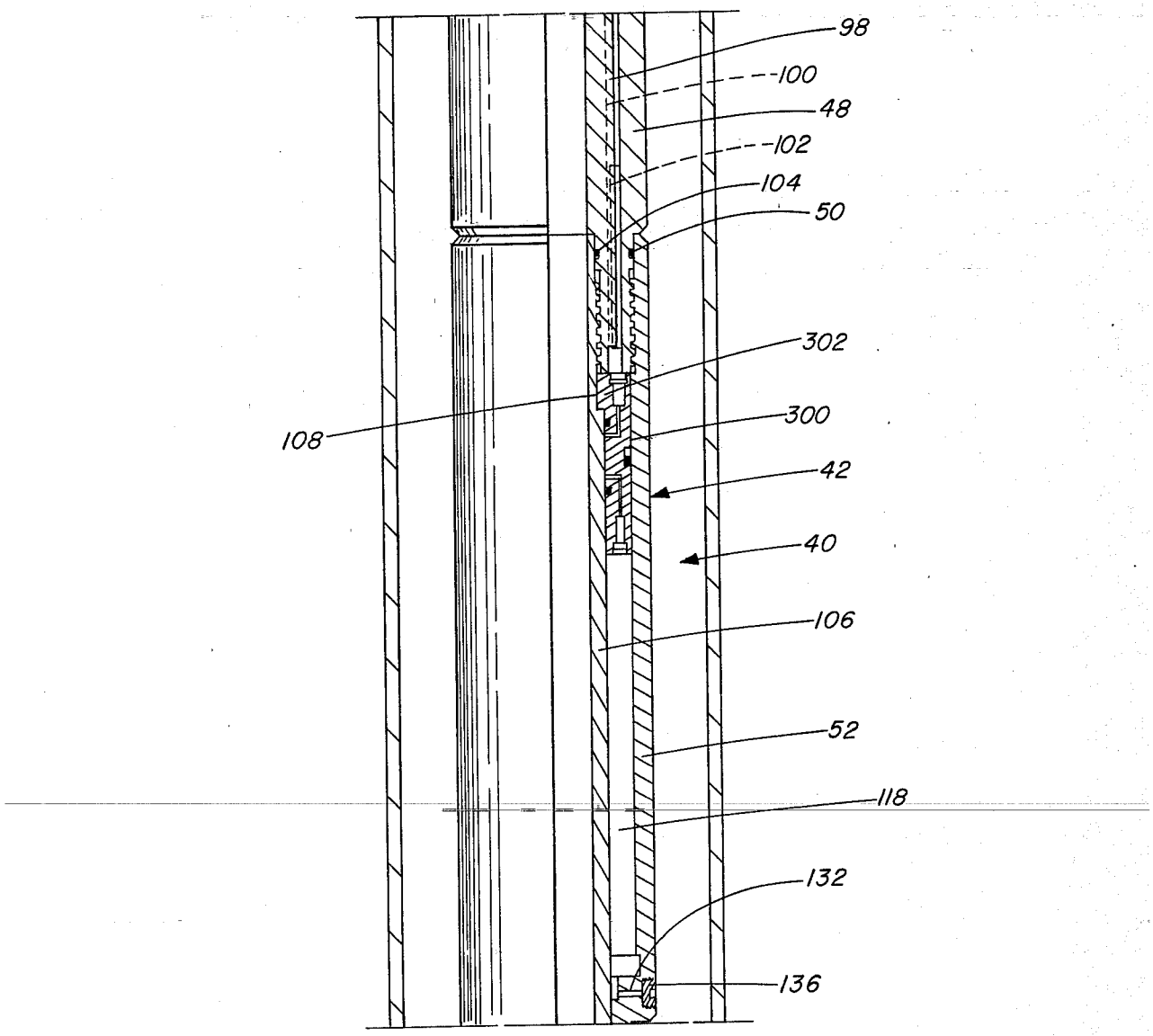
Figure 1C:
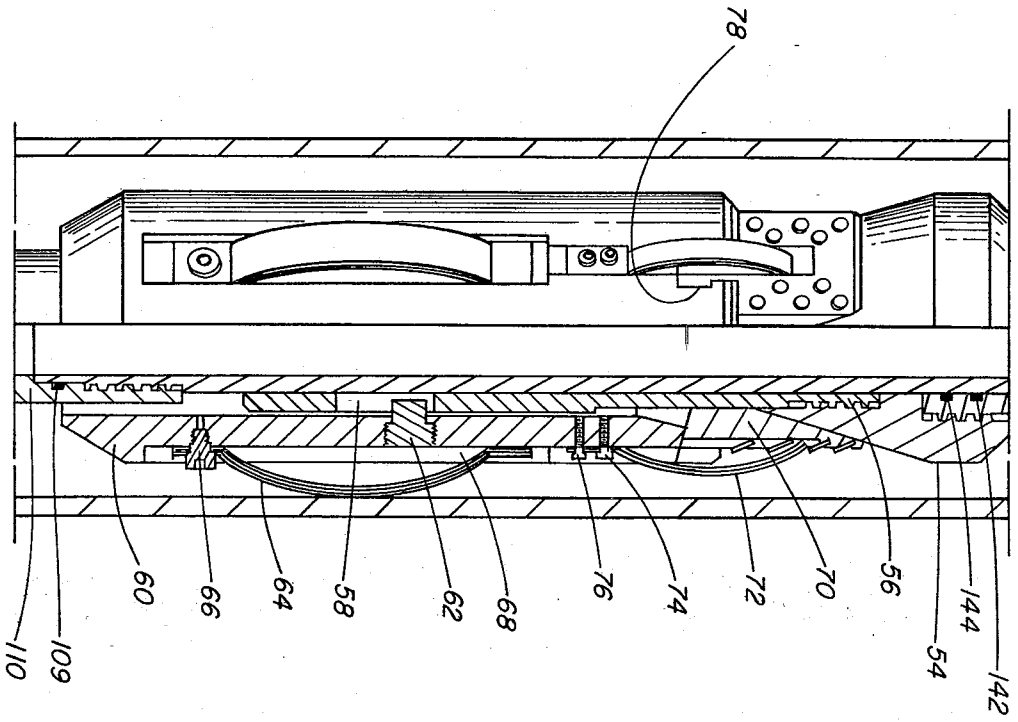
Figure 1D:
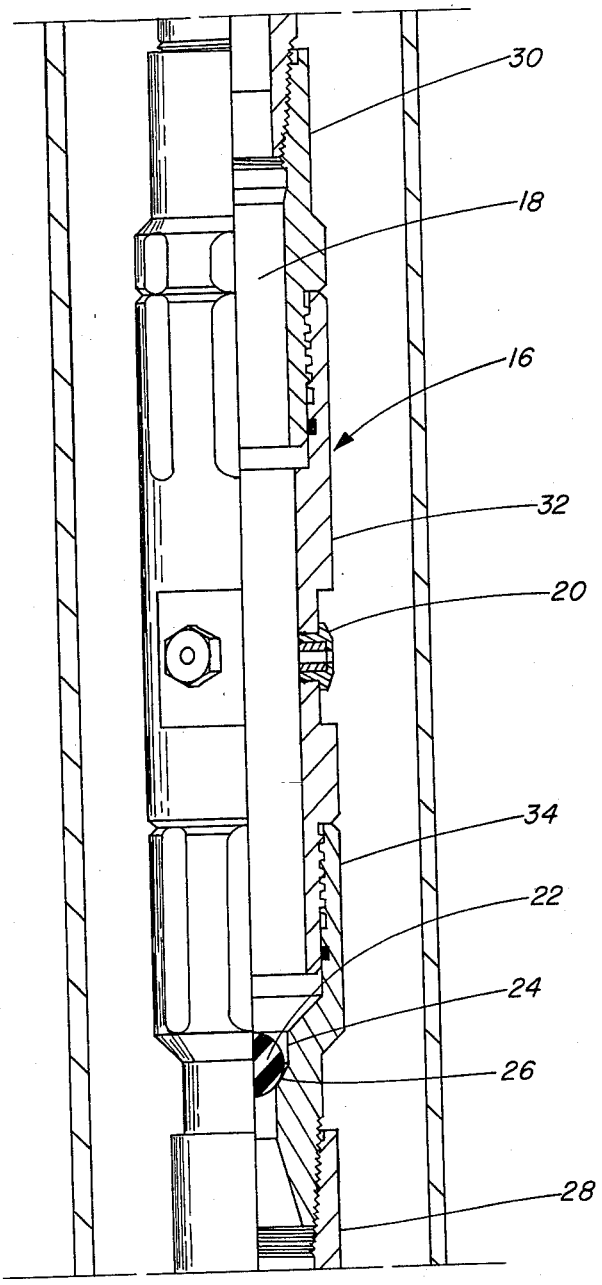
Figure 2A:
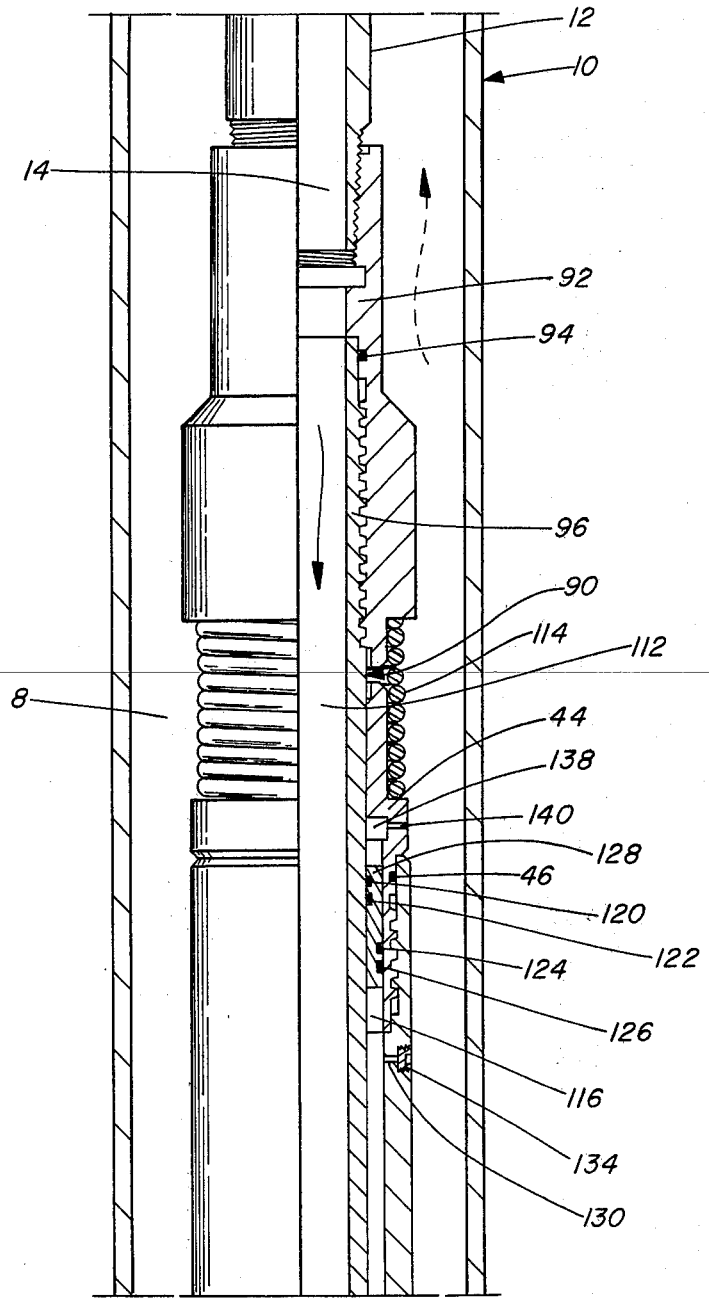
FIGS. 2A through 2D are vertical half-sectional elevations showing the present invention anchored in the well casing at the end of a slotting pass.
Figure 2B:
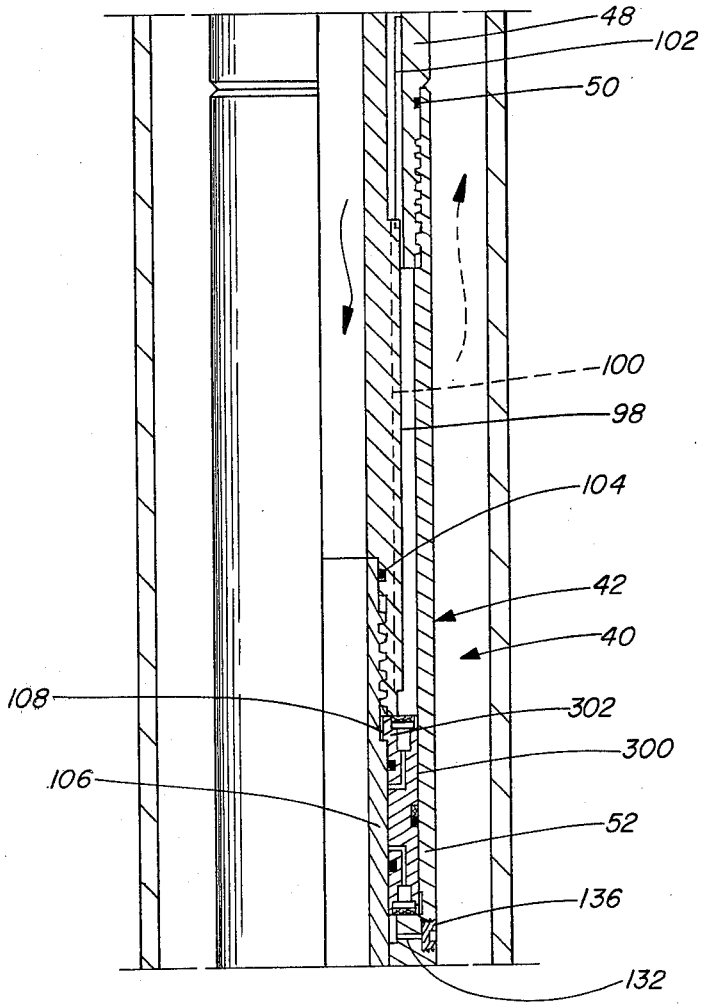
Figure 2C:
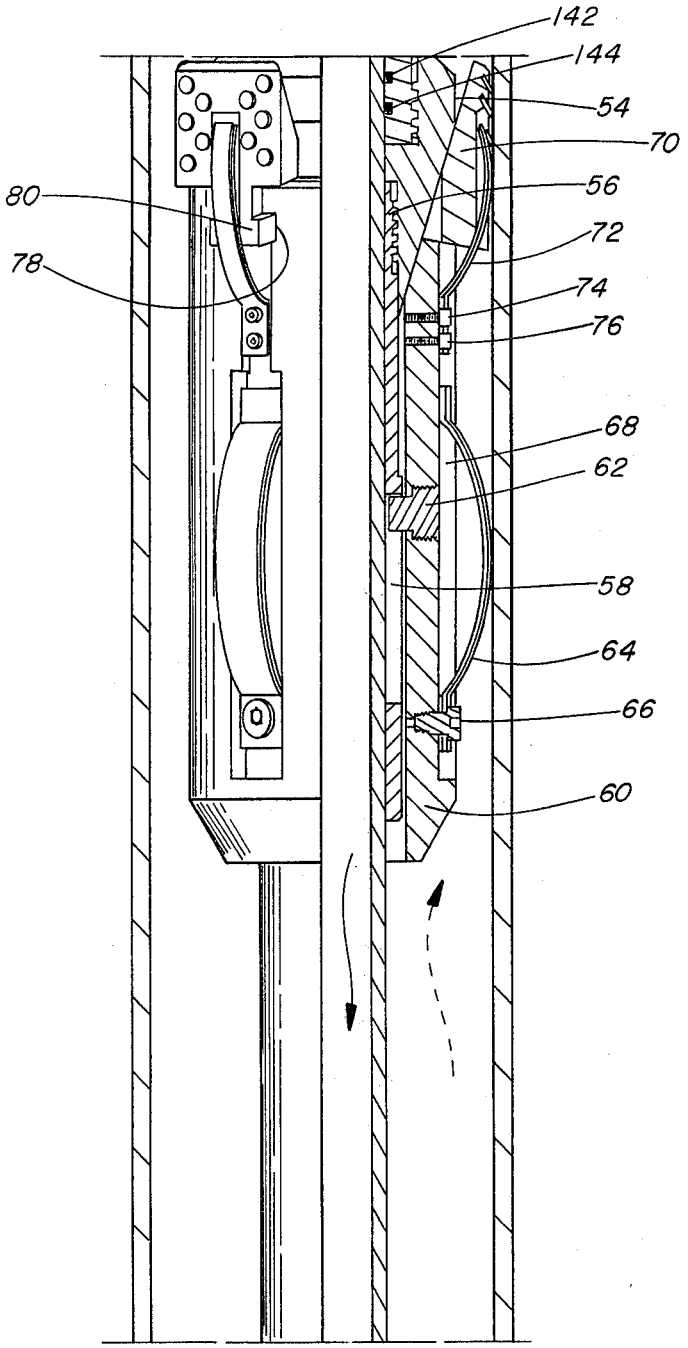

FIGS. 1A through 1D and 2A through 2D, illustrate the preferred embodiment of the slotting assembly of the present invention. Slotting assembly 40 is suspended in casing 10 by threaded engagement with pipe string 12 having bore 14 therethrough. The lower end of slotting assembly 40 is in threaded engagement with jet body 16 having bore 18 therethrough, and jet nozzles 20 (which are formed of or coated with an abrasion resistant metal such as tungsten carbide) circumferentially spaced thereabout, in this instance at 120° intervals. Ball 22, which may be formed of a phenolic compound, is shown seated on seat 26 in constriction 24 at the lower end of jet body 16; the purpose of ball 22 will be discussed hereafter. The top of end guide 28, an optional blank threaded piece of pipe to protect the threaded end of jet body 16, is shown at the bottom of FIG. 1D. It may be noted at this time that jet body 16, comprising upper jet body adapter 30, nozzle body 32 and seat housing 34, may be extended in length by the insertion of additional nozzle bodies 32 between jet body adapter 30 and seat housing 34, so as to obtain the ability to cut slots at multiple adjacent longitudinal locations at the same time. Of course, it is possible to run nozzle bodies in spaced relationship to each other, inserting a piece of pipe of appropriate length therebetween, or to run a nozzle body above the slotting mechanism and another below it, or a nozzle body or bodies above the slotting assembly.

Figure 3:
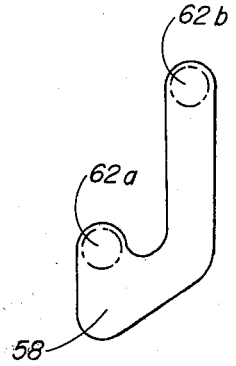
FIGS. 3 and 4 show alternative embodiments of J-slots which may be employed to engage and disengage the slips employed with the slotting assembly.

Slotting assembly 40 comprises a housing assembly 42 surrounding a mandrel assembly 90. Housing assembly 42 comprises piston housing 44, which is threaded to upper case 48, O-ring 46 creating a seal therebetween. Lower case 52 is threaded to upper case 48, O-ring 50 sealing therebetween. Wedge 54 is threaded to lower case 52 at its upper end, and to J-slot sleeve 56 at its lower end. Slip body 60 surrounds J-slot sleeve 56 in slidable engagement therewith, J-slot pin 62 being fixed to slip body 60 at one end, the other riding in J-slot 58 in J-slot sleeve 56; a development of J-slot 58 is shown in FIG. 3. Drag springs 64 are fixed in spaced circumferential relationship to slip body 60 by retaining bolts 66 in longitudinal grooves 68. Slips 70 are circumferentially aligned with drag springs 64, and are retained against wedge 54 and J-slot sleeve 56 by retaining springs 72, which are fixed to slip body 60 by screws 74 and 76. It should be noted that the upper extent of slip body 60 overshoots slips 70 in their retracted position (FIG. 1C), keyway slots 78 being cut into the overshot which cooperate with similarly configured keys 80 in the lower portion of wedges 70 (see FIG. 2C). Mandrel assembly 90, slidably disposed in housing assembly 42, comprises upper adapter 92, which is threaded to upper mandrel 96, O-ring 94 sealing therebetween. Upper mandrel 96 is of substantially uniform diameter at its upper end, and at its lower end possesses splines 98 at 180° intervals which cooperate with longitudinal grooves cut into upper case 48 to prevent rotation of mandrel assembly 90 with respect to housing assembly 42. Broken line 100 indicates the height of splines 98 shown at the righthand side of FIGS. 1A and 1B, while broken line 102 shows the radial and longitudinal extent of the cooperating groove in upper case 48. Upper mandrel 96 is threaded to lower mandrel 106, with O-ring 104 therebetween, and metering cartridge assembly 300 is held between upper mandrel 96 and lower mandrel 106 by the protrusion of radial lip 302 into annular space 108. Lower mandrel 106 is of substantially uniform diameter below the area of annulus space 108, and is fixed to lower adapter 110 at its lower end. Lower adapter 110 is, in turn, attached to jet body 16 by upper jet body adapter 30. A substantially uniform bore 112 extends throughout mandrel assembly 90. Mandrel assembly is biased longitudinally away from housing assembly 42 by coil spring 114.

Slotting assembly 40 possesses an upper annular chamber 116 and a lower annular chamber 118 formed between mandrel assembly 90 and the inside of housing assembly 42. The chambers are sealed at their upper end by O-rings 120 and 122 on the inside and 124 and 126 on the outside of floating ring piston 128, which is disposed between mandrel assembly 90 and housing assembly 42. At the lower end of lower annular chamber 118, O-rings 142 and 144 provide a seal. Both upper annular chamber 116 and lower annular chamber 118 are filled with a suitable fluid, such as 20 CST oil, through apertures 130 and 132, respectively. After filling the chambers are sealed with plugs 134 and 136. At the upper end of floating ring piston 128 is pressure chamber 138, which is open to the outside of casing assembly 42 through aperture 140.

Figure 5:
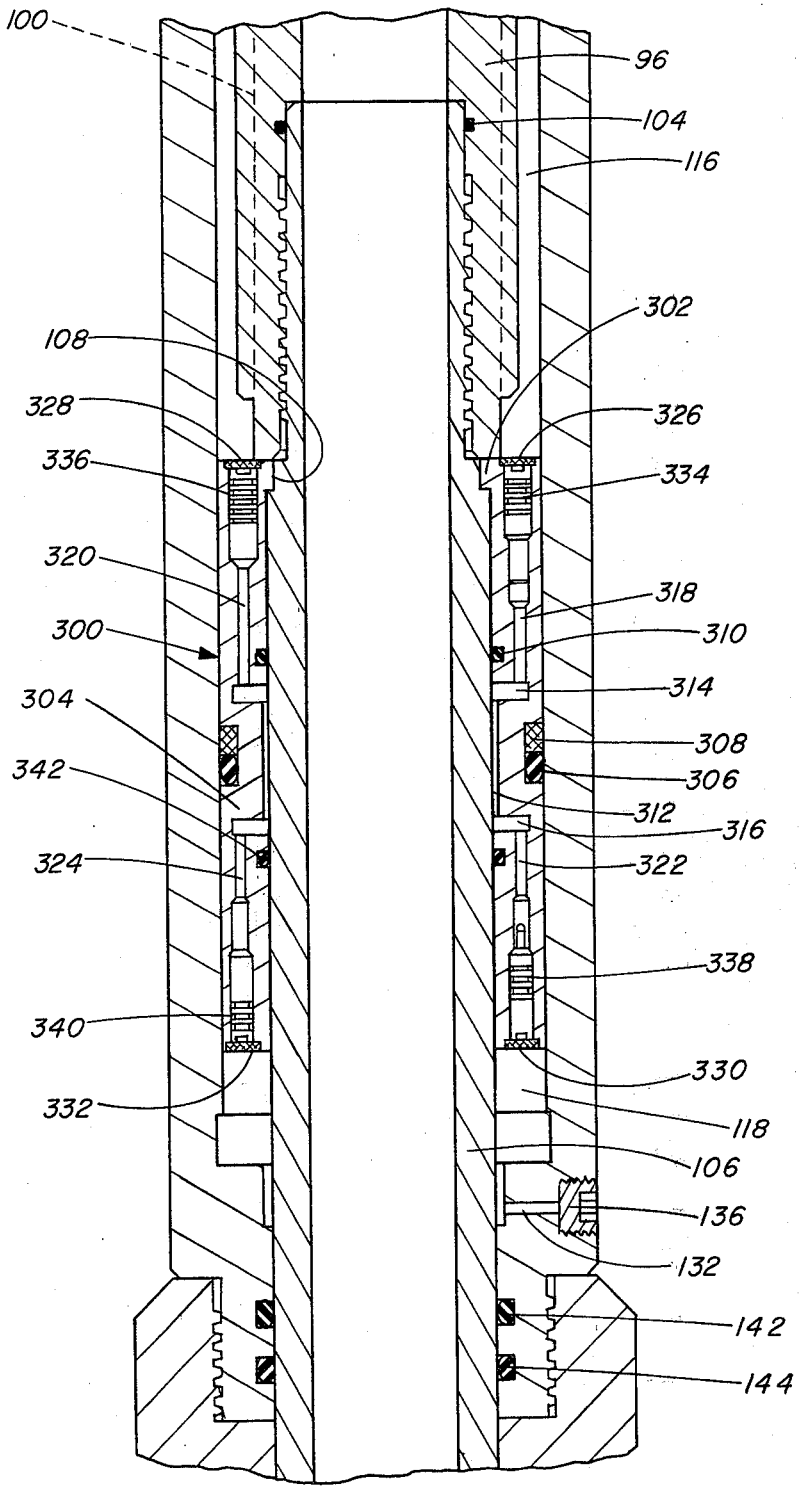
FIG. 5 is an enlarged vertical cross-sectional elevation of the metering cartridge of the present invention.

Referring to FIG. 5, which is a full cross-sectional enlargement of metering assembly 300 during a portion of the stroke of mandrel assembly 90 during operation of the tool, lip 302 in metering body 304 is fixed between upper mandrel 96 and lower mandrel 106, as previously noted. Metering body 304 is of substantially uniform diameter on the outside, a seal between metering body 304 and the inside of lower case 52 being effected by O-ring 306 and back-up seal 308. The bore of metering body 304 is smaller at its upper and lower ends, a substantially tight fit being achieved with lower mandrel 106, while the median portion of the metering body bore between O-rings 310 and 342 is of increased diameter, creating metering annulus 312 connecting upper annular channel 314 and lower annular channel 316. Upper annular channel communicates with metering bore 318 and relief bore 320, while lower annular channel communicates with metering bore 322 and relief bore 324. Bores 318, 320, 322 and 324 are terminated by screens 326, 328, 330 and 332, which may be individual screens or an annular screen at each end of metering body 304, covering the ends of the bores. Between screen 326 and channel 314, in an enlarged section of metering bore 318, is pressure relief valve 334; a suitable commercially available pressure relief valve is produced by The Lee Company, 2 Pettipaug Road, Westbrook, Connecticut. Between screen 328 and channel 314, in an enlarged section of relief bore 320 is check valve 336; a suitable commercially available check valve is the "LEECHEK," produced by The Lee Company. Between screen 330 and annular channel 316 in an enlarged section of metering bore 322 is a fluid flow restriction jet assembly 338; a suitable commercially available jet assembly is the "LEE VISCO JET," produced by The Lee Company, the structure and operation of which is disclosed in U.S. Pat. No. 3,323,550, which patent, and the subject matter thereof, is incorporated herein by reference. Between screen 332 and annular channel 316 in an enlarged portion of relief bore 324 is a check valve 340; a suitable commercially available check valve is the "LEECHEK," produced by The Lee Company. Below annular channel 316 O-ring 342 prevents oil passing to and from lower annular chamber 118 from bypassing jet assembly 338 and check valve 340.

The operation of slotting mechanism 40 in conjunction with the jet body 16 will now be described with reference to FIGS. 1, 2, 3 and 5 in the context, by way of illustration and not of limitation, of an oil well. Slotting assembly 40 is suspended in steel casing 10 in the well bore by pipe string 12, the slotting assembly 40 in the retracted position as shown in FIG. 1, J-slot pin 62 being in position 62*a* (FIG. 3) in slot 58, slips 70 thereby being locked out of engagement with casing 10, and drag springs 64 providing a centralizing effect to minimize hang-ups as the tool travels down the casing bore. At the level to be slotted, the pipe string 12 is picked up, rotated to the right and set down, moving J-slot pin 62 (relative to J-slot sleeve 56) from position 62*a* to the bottom of the J-slot, then to position 62*b* at the top of the "J". The actual movement in slotting assembly 40 is of the J-slot sleeve; its downward movement forces slips 70 to travel relatively upward and radially outward upon wedge 54, slips 70 thereby making contact with and holding slotting assembly 40 against the inside wall of casing 10 (FIG. 2C), the weight of pipe string 12 acting through wedge 54 to hold slips 70 engaged with casing 10. The seating of slips 70 prevents further downward movement of the slotting assembly 40. To commence slotting, an abrasive-laden fluid such as a mixture of 1 pound of sand per gallon of water is pumped at a suitable pressure, such as 3,000 PSI down pipe string bore 14 through slotting assembly 40 to jet body 16, where ball 22 prevents further downward flow, and the fluid is directed out of the jet nozzles 20 at the casing wall, and subsequently returned to the surface through the well bore annulus surrounding the pipe string. In most instances, it is desirable to dwell at the initial jet position for a period of time such as three minutes, to ensure that the casing has been penetrated before slotting commences. The operator may load the pipe string with an amount of weight less than that required to start mandrel movement during the dwell time, after which the desired amount of weight, for example 15,000 pounds, is set down on the slotting assembly through the pipe string to begin the travel of mandrel assembly 90 and hence jet body 16, which is attached to mandrel assembly 90, downward at a predetermined rate, for example one-half inch per minute.

The rate of downward travel is controlled by the metering of fluid through metering cartridge 300 from lower annular chamber 118 to upper annular chamber 116. As the slotting assembly 40 descends into the well, the increased pressure acts upon floating ring piston 128 through aperture 140 and annulus pressure chamber 138; the well bore pressure thus ensures that any compressible components in the oil in chambers 116 and 118 are already compressed and that the oil is at the same pressure as fluid in the well bore, so the apparatus will have the same operating characteristics regardless of the depth to which the tool is run. Annular chambers 116 and 118 are of variable length, depending on the position of metering cartridge 300. At the commencement of the mandrel stroke, lower annular chamber 118 is the larger of the two chambers, having most of the oil therein. Oil from lower annular chamber is pressurized by the pipe weight applied, which opens pressure relief valve 334 at a predetermined pressure corresponding to the pipe weight set down, for example 2,500 PSI, and oil flows at a controlled rate to upper annular chamber 116 through fluid flow restricting jet assembly 338, metering bore 322, lower annular channel 316, metering annulus 312, upper annular channel 314, metering bore 318, and pressure relief valve 334. Check valves 336 and 340 are closed to flow from the lower annular chamber 118, so that all of the oil is forced through fluid flow restriction jet assembly 338. The rate of travel of mandrel assembly 90 is controlled in this manner during its entire stroke, in this instance, ten inches. At the end of the stroke, one or more slots 160 (depending on the number of jet nozzles in jet body 16), slightly greater in length than the stroke, will have been cut in the casing (see FIG. 2D), and the cement around the casing and the surrounding formation (not shown) will also have been penetrated. At end of the stroke, spring 114 will be compressed, and most of the oil will be in upper chamber 116. The slotting assembly 40 may now be disengaged from the casing 10 by pulling upward on pipe string 12, which automatically retracts slips 70 and locks them in the retracted position as soon as any further downward motion is attempted due to the travel of J-slot pin 62 in J-slot 58. The automatic retraction is due to the oblique bottom of J-slot 58, which guides J-slot pin 62 to the bottom of the short leg of the "J", from which any subsequent downward motion of the pipe string moves J-slot pin 62 to position 62*a*. The mandrel assembly 90 will be pulled back (actually, the housing assembly 42 will travel downward) as the pipe string 12 is pulled up, due to the weight of housing assembly 42 and the restorative force of compressed spring 114. Oil will travel back to lower annular chamber 118 from upper annular chamber 116 through check valve 336, relief bore 320, upper annular channel 314, metering annulus 312, lower annular channel 316, relief bore 324 and check valve 340, both check valves opening in response to flow from the upper annular chamber 116.

Once the mandrel assembly has returned to its original position, the tool is ready to be repositioned for another slotting cycle, either above or below the first set of slots. It should be noted that, in relatively shallow wells where weight of the pipe string is not a problem, the slotting assembly may be run upside down and made to operate with an upward pull (for example 15,000 pounds again) above pipe weight.

When all slotting operations are finished, ball 22 may be reversed out by pumping fluid down the annulus between pipe string 12 and casing 10, so that the entire tool string can drain while tripping out of the hole.

Figure 4:
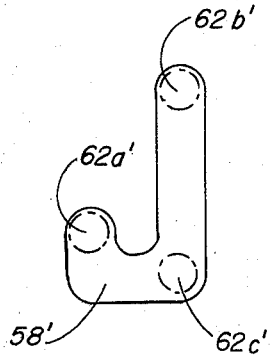
Figure 2D:
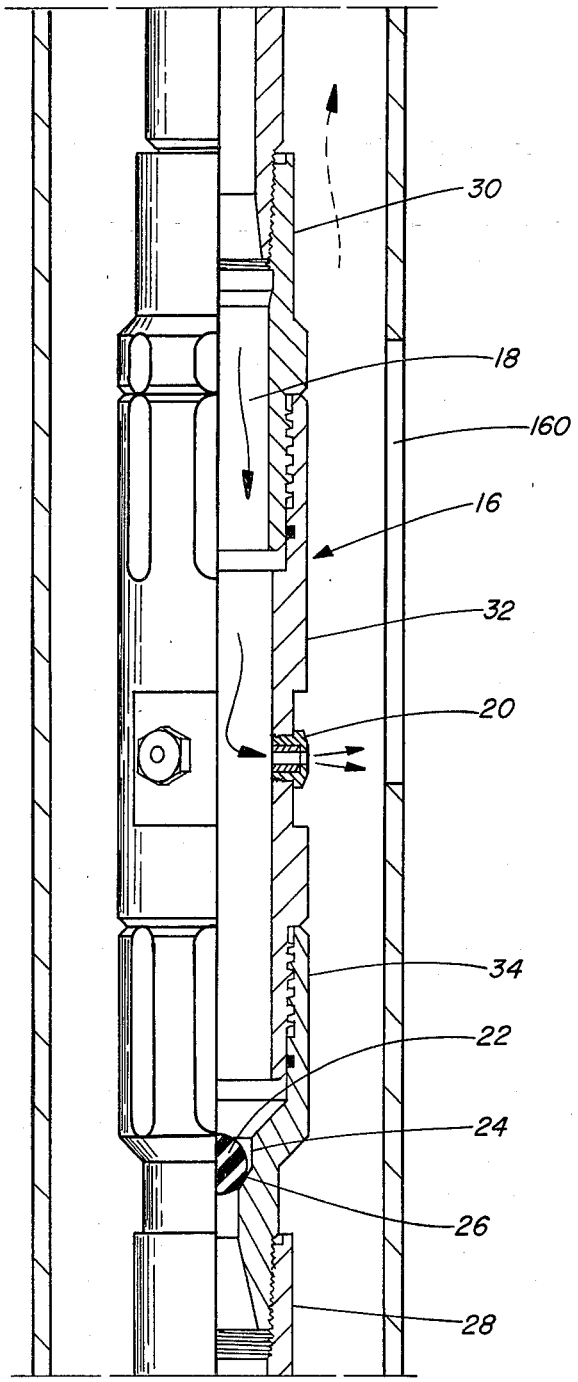

A rotating J-slot 58', as shown in FIG. 4 may be employed as an alternative to the automatic J-slot 58 of FIG. 3. The rotating J-slot, due to its horizontally, rather than obliquely, extending lower edge, requires picking up the pipe string, rotating slightly to the right, and setting down to release the slips 70 and lock slotting assembly 40 in the casing. J-slot pin 62 moves from position 62*a* at the top of the short leg of the "J" to the bottom when picking up, is moved laterally to the bottom of the long leg of the "J" when rotating, and travels to position 62*b'* at the top of the long leg when setting down. To retract and lock the slips in a retracted position (FIG. 1C), the operator picks up and rotates the pipe string slightly to the left. The non-automatic locking feature of the rotating J-slot 58' may be employed when it is necessary to cut casing in several passes, such as when an extremely tough metal alloy might be employed. Furthermore, if it is desired to penetrate the surrounding formation to a greater extent than is possible in a single pass, a second pass may be used to extend the cut laterally into the formation through the slot cut in the casing and cement during the first pass of the tool. Also, if the operator is cutting a large number of longitudinally adjacent slots, he can start at the bottom of the interval to be slotted, cut the first slot, pick the pipe string straight up to the second pass level, set down again, and the slotting assembly will anchor. Due to the travel of J-slot pin 62 from position 62*b'* to 62*c'* in J-slot 58' during picking up, and back to position 62*b'* when setting down (rather than to position 62*a* as would occur with J-slot 58) the slotting assembly 40 may be moved and re-set without rotation for as many passes as are needed.

Figure 6:
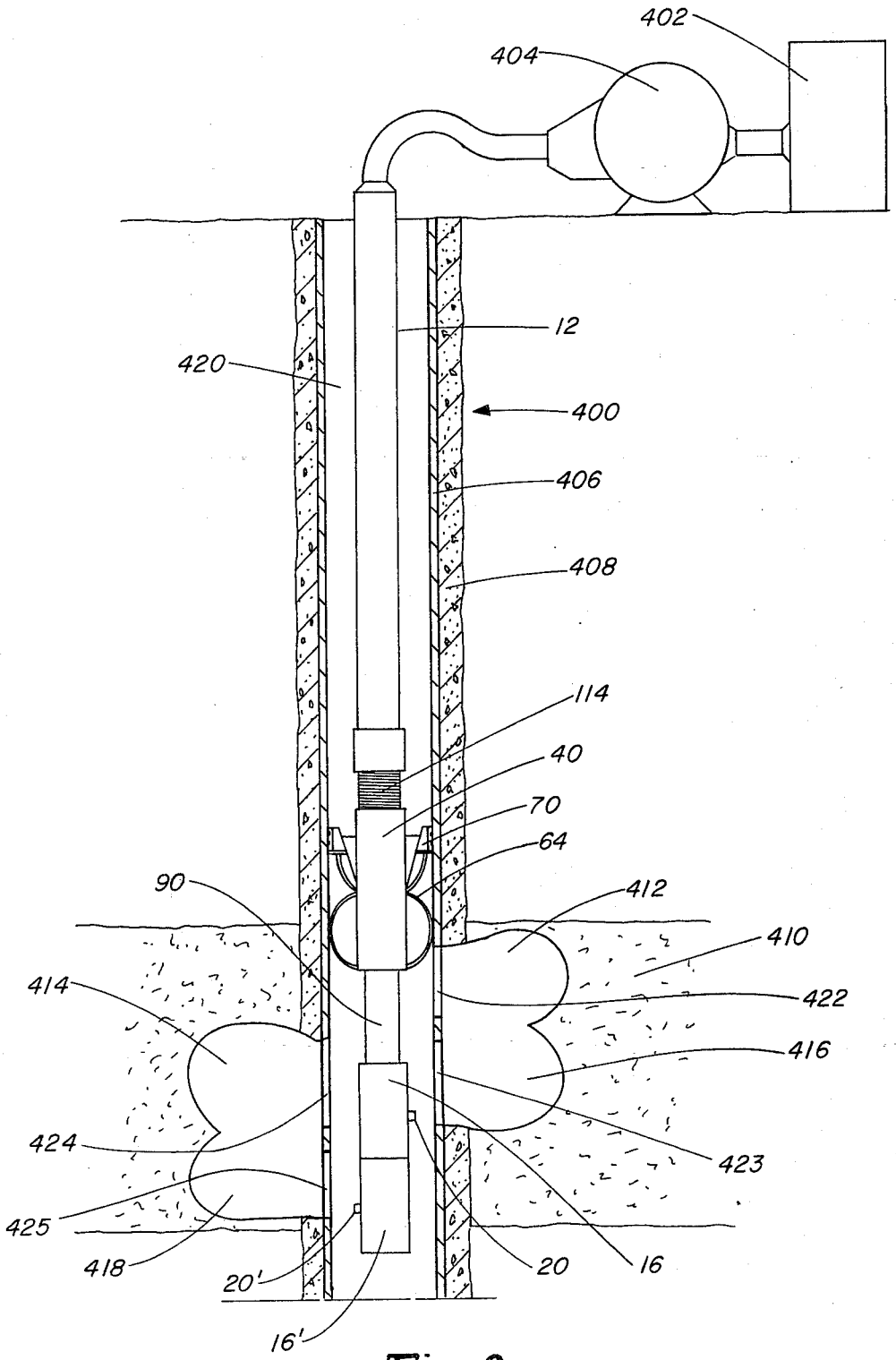
FIG. 6 is a schematic view illustrating the use of the present invention in a well in a multiple pass slot elongation operation where slots from adjacent passes have been connected.

As noted briefly above, a major advantage of the present invention is its ability to cut greatly elongated slots in a multiple step operation. A slotting operation including the elongation of slots is illustrated by FIG. 6. Storage tank 402 containing a suitable fluid is located near well 400. Such a fluid may comprise either water or sand mixed with water in a concentration range, for example, of about one-eighth to one pound of sand per gallon of water; the composition of the fluid is, of course, dependent on the casing material, thickness, rate of travel of the jet, pressure, distance from jet to casing, and depth to which the formation is to be cut behind the casing. Depending on the diameter of jet nozzles 20 and 20' in jet bodies 16 and 16' (which are substantially idential), and the type of casing to be slotted, the sand may range in size from 40–60 mesh to 220 mesh with 100 mesh sand being a generally employed size. A gel containing a thixotropic solution such as water, bentonite, and sand may be used in order to suspend the sand when flow ceases. The fluid is drawn from tank 402 to pump 404, and pumped downhole through pipe string 12, which is suspended in well 400 by conventional surface equipment, not shown. Well 400 is lined with casing 406, which has previously been cemented in the well so that an envelope of cement 408 surrounds the casing. Slotting assembly 40, shown schematically, has been lowered to the level of producing formation 410, and has been set in the well bore with slips 70, being centralized during its trip downhole by drag springs 64 (it being understood that there are other slips and drag springs, not shown, spaced around the circumference of slotting assembly 40). As can be seen, slotting assembly 40 is at the end of the second stroke of mandrel assembly 90, jet bodies 16 and 16' having slotted the casing at 423 and 425, the abrasive jets having cut into the surrounding formation in areas 416 and 418. Coil spring 114 is compressed to return the mandrel to its original position when pipe string 12 is picked up and slips 70 are released. It may be noted that in a previous stroke, casing slots 422 and 424 were cut, and the formation jetted in areas 412 and 414 with areas 416 and 481 contiguous. The second pass of the tool provided both an elongated slot effect and a longitudinally extended lateral penetration of the cement and formation surrounding the casing. If the formation is thicker than that shown, or if further elongation is required for another purpose, third, fourth, and subsequent passes of the tool can obviously be employed. Adjacent, but not contiguous slots have been shown, as in most instances creating a long continuous slot would mechanically weaken the casing to the point of possible collapse. The penetration of the formation behind the casing is continuous, however, and gives the practical effect of a single, long slot. While a single jet nozzle is shown for each of jet bodies 16 and 16', this is for purposes of illustration only, it being understood that a plurality of jet nozzles at 90°, 120°, 180° or any other suitable intervals may be incorporated in a jet body. If a single jet nozzle is employed, it is possible to use centralizers on the opposite side of the jet body to prevent the thrust of the fluid jet from creating excessive standoff between the jet nozzle and the casing.

The slotting assembly of the present invention permits single pass slotting, as the composition of the abrasive fluid, nozzle size, and delivery pressure have been precalculated and are altered with the casing material and wall thickness to be slotted and the depth of penetration sought behind the casing. For example, a steel casing may be slotted using a mixture of one pound sand per gallon of water, at 3,000 PSI delivery pressure, as noted above. A lesser concentration of sand may be employed at higher pressure, or lower rate of jet travel, or both. It is obvious to one of ordinary skill in the art that these parameters may vary greatly according to the particular result desired. A polyvinyl chloride casing may be slotted using only water as the fluid, while a glass fiber reinforced thermosetting epoxy resin casing requires a sand mixture as a water jet will cause the casing to break and/or delaminate, rather than giving a clean slot. Similarly, a pressure of 5,000 to 15,000 PSI, preferably 8,000 to 10,000 PSI, on a polyvinyl chloride casing, while a pressure of less than 4,000 PSI is desirable on glass fiber reinforced thermosetting epoxy resin casings. In all instances, distance from the jet nozzle to the casing wall is also important, as too great a distance not cut through the casing or cut too wide a slot, while too close a distance will cause excessive splash-back of abrasive material against the jet body, causing damage to the body itself. The utilization of wear or splash plates on the jet body of tungsten carbide or ceramic is an important consideration when employing more abrasive fluid mixtures at high pressures during a single-pass slotting operation of the type disclosed herein, as the splash-back is more severe than in multiple pass operations due to tendency for the splash-back to be focused above the jet nozzle as the nozzle travels downward, so it is more possible to erode a hole in the jet body than if jetting passes are made in two directions. The construction of a jet body with splash plates is shown in U.S. Pat. Nos. 3,145,776 and 4,050,529, as noted above.

The rate of travel of the slotting assembly mandrel is, of course, a matter of choice, as is the amount of pipe weight needed to begin mandrel travel. If one is slotting polyvinyl chloride casing rather than the steel casing discussed above, it may be expeditious to replace the 2,500 PSI relief valve in the metering body with one responsive to a pipe string weight of less than 15,000 pounds, so as to avoid placing too much stress on the casing through the slips. The rate of travel might also be increased or decreased depending on the extent lateral penetration to be obtained behind the casing and the thickness and material of the casing wall.

It is apparent that a new and improved method and apparatus for slotting well casings and other flow conductors has been described and illustrated. The use of an anchored slotting mechanism and predetermined jet body travel gives a more precise location to the slots, and the ability to elongate slots using multiple contiguous passes is unknown in the prior art. Furthermore, the operation of the slotting is greatly simplified, involving only the application of weight to the pipe string, instead of a reciprocation as previously employed. In addition, there are no limitations with respect to hole depth and deviation such as experienced with continuous tubing. The present invention also encompasses a new and advantageous method and apparatus for perforating formations, without the damage associated with explosive methods, and with greater control of penetration by the abrasive jet than is possible with existing tools. The invention has been described in the context of slotting well flow conductors in earth formations, but it is apparent that it may be employed wherever slotting of a hollow body is required.

While the invention has been described in terms of a preferred embodiment, it will be understood that modifications to the apparatus and method described herein would be obvious to one of ordinary skill in the art. For example, a gas-type restorative spring could be employed to reset the mandrel assembly. The metering cartridge could be fixed to the casing assembly rather than to the mandrel assembly, which would then include a ring piston fixed thereto to pressurize the oil. The J-slot and pin mechanism could be reversed with the J-slot sleeve surrounding an inner casing and doubling as a slip body, carrying drag springs. Spring-loaded drag blocks may be employed in lieu of drag springs, and a single spline and groove arrangement may be employed to prevent relative rotation of the housing and mandrel. These and other modifications can be made without departing from the spirit and scope of the invention, the following claims being understood to include such modifications.

We claim:

1. Apparatus for controlling the rate of tool movement in a well casing, comprising:

housing means having slip means thereon, said slip means adapted to engage said well casing;

mandrel means longitudinally slidably disposed in said housing means;

spring means adapted to bias said mandrel means against longitudinal movement; and metering means adapted to control the rate of longitudinal movement of said mandrel means with respect to said housing means.

2. The apparatus of claim 1, wherein said slip means is selectively engageable with said well casing.

3. The apparatus of claim 2, wherein said selective engagement of said slip means is controlled by J-slot means.

4. The apparatus of claim 3, wherein said J-slot means comprises a J-slot in said housing means, a pin fixed at one end to said slip body means slidably mounted on said housing means, the free end of said pin disposed within said J-slot, said slip body having attached thereto said slip means.

5. The apparatus of claim 1, further comprising annular wedge means surrounding said housing means longitudinally adjacent to said slip means, said slip means being biased radially outward by longitudinal contact with said wedge means.

6. The apparatus of claim 1, wherein said mandrel means is adapted to connect to a pipe string.

7. The apparatus of claim 1, wherein said metering means is hydraulic metering means.

8. The apparatus of claim 7, wherein said hydraulic metering means meters fluid transfer between upper end lower chamber means.

9. The apparatus of claim 8, wherein said upper chamber and said lower chamber are disposed between said mandrel means and said housing means.

10. The apparatus of claim 9, wherein said hydraulic metering means further comprises metering cartridge means between said upper chamber and said lower chamber.

11. The apparatus of claim 10, wherein said metering cartridge means possesses jet means to meter said fluid transfer between said upper and lower chambers, in a first direction, and check valve means to permit free flow of said fluid in a second, opposite direction.

12. The apparatus of claim 11, wherein said metering cartridge means further possesses pressure relief means in series with said jet means, said pressure relief means adapted to open in response to a predetermined fluid pressure in one of said chambers.

13. The apparatus of claim 11, wherein said metering cartridge means is fixed to said mandrel means and in slidable sealing engagement with said housing means, and said upper and lower chambers are of variable volume.

14. The apparatus of claim 11, wherein said check valve means comprises first and second check valves, said first check valve adapted to prevent fluid bypass of said jet means in said first direction, and said second check valve adapted to prevent fluid bypass of said pressure relief means in said first direction.

15. The apparatus of claim 8 and further comprising pressure compensation means, said pressure compensation means adapted to subject said fluid to the ambient pressure surrounding said apparatus.

16. The apparatus of claim 15, wherein said pressure compensation means subjects said fluid to said ambient pressure through slidable piston means.

17. The apparatus of claim 16, wherein said ambient pressure acts directly on one end of said piston means, another end of said piston acting on said fluid.

18. The apparatus of claim 17, wherein said rate of longitudinal movement is substantially constant.

19. The apparatus of claim 18, wherein said jet means determines said rate of longitudinal movement.

20. The apparatus of claim 12, wherein said mandrel means moves longitudinally in response to the application of longitudinal force sufficient to overcome said bias and to generate at least enough fluid pressure in one of said chambers to open said pressure relief means.

21. The apparatus of claim 20, wherein said fluid pressure is developed in said lower chamber, and said fluid transfer is from said lower chamber to said upper chamber.

22. The apparatus of claim 1, wherein the extent of said longitudinal movement is predetermined.

23. The apparatus of claim 22, wherein said extent of movement is substantially equal to the total length of said upper and said lower chambers.

24. The apparatus of claim 1, wherein said mandrel means is adapted to connect to jet body means.

25. The apparatus of claim 1, further comprising drag spring means circumferentially mounted on said housing means.

26. The apparatus of claim 1, wherein said mandrel means is adapted to connect to a pipe string, and said slip means are selectively releasable to engage with said well casing through longitudinal and rotational movement of said pipe string.

27. The apparatus of claim 26, wherein said slip means are selectively retractable through longitudinal movement of said pipe string.

28. The apparatus of claim 27, wherein said slip means are selectively lockable in a retractable position through longitudinal movement of said pipe string.

29. The apparatus of claim 27, wherein said slip means are selectively lockable in a retracted position through rotational movement of said pipe string.

30. A control assembly adapted to be connected to a pipe string and disposed in a well casing, comprising:

substantially cylindrical housing means having selectively releasable slip means thereon, said slip means being selectively releasable to engage said casing through longitudinal and rotational movement of said pipe string;

substantially tubular mandrel means longitudinally slidably disposed in said housing means;

metering means mounted on said mandrel means within said housing means;

first and second longitudinally spaced chambers between said housing means and said mandrel means, said chambers being separated by said metering means; and fluid in said first and second chambers, said metering means adapted to meter the rate of flow of said fluid between said first and second chambers.

31. The apparatus of claim 30, further comprising pressure compensation means adapted to subject said fluid to the ambient pressure of the casing bore at the location of said control assembly.

32. The apparatus of claim 31, wherein said pressure compensation means subjects said fluid to said ambient pressure through slidable piston means.

33. The apparatus of claim 32, wherein said ambient pressure acts directly on one end of said piston means, another end of said piston acting on said fluid.

34. The apparatus of claim 30, wherein said slip means are selectively retractable through longitudinal movement of said pipe string.

35. The apparatus of claim 34, wherein said slip means are selectively lockable in a retracted position through longitudinal movement of said pipe string.

36. The apparatus of claim 34, wherein said slip means are selectively lockable in a retracted position through rotational movement of said pipe string.

37. The apparatus of claim 35 or 36, wherein said release, retraction and locking of said slip means is controlled by J-slot means.

38. The apparatus of claim 37, wherein said J-slot means comprises a J-slot in said housing means, a pin fixed at one end to said slip body means slidably mounted on said housing means, the free end of said pin disposed within said J-slot, said slip body having attached thereto said slip means.

39. The apparatus of claim 38, further comprising annular wedge means surrounding said housing means longitudinally adjacent to said slip means, said slip means being biased radially outward by longitudinal contact with said wedge means.

40. The apparatus of claim 33, wherein said metering means further comprises jet means, pressure relief means and check valve means;

said jet means controlling the rate of fluid flow from one chamber to the other in a first direction;

said pressure relief means being in series with said jet means and being adapted to open at a predetermined pressure; and said check valve means adapted to permit fluid flow in a second, opposite direction from one chamber to another and being in parallel with said pressure relief means and said jet means.

41. The apparatus of claim 40, wherein said fluid pressure is developed in said lower chamber and said fluid flow is from said lower chamber to said upper chamber.

42. The apparatus of claim 41, wherein said predetermined pressure is generated in said fluid by engaging said slip means with said casing and applying longitudinal force to said mandrel means through said pipe string.

43. The apparatus of claim 42, further comprising spring means biasing said mandrel means and said housing means longitudinally away from each other.

44. The apparatus of claim 43, wherein said mandrel means is adapted to connect to jet body means.

45. An apparatus for controlling the rate and extent of travel of a jet body attached thereto in slotting well casing, said apparatus being adapted to be suspended in said casing from a pipe string, comprising:

a substantially cylindrical housing having slips slidably mounted thereon;

a slip body to which said slips are attached, slidably mounted on said housing, said slip body having fixed thereto a pin, the free end of which is slidably disposed in a J-slot in said housing;

annular wedge means longitudinally adjacent to said slips and adapted to bias said slips radially outward upon longitudinal contact therewith;

a substantially tubular mandrel longitudinally slidably extending through said housing and having fixed thereto fluid metering means;

an upper chamber defined by said housing, said mandrel, said metering means and a longitudinally slidable ring piston disposed between said housing and said mandrel, said ring piston being exposed to the ambient pressure in the casing bore;

a lower chamber defined by said housing, said mandrel and said metering means;

substantially incompressible fluid in said upper and lower chambers; and spring means adapted to longitudinally bias said mandrel away from said housing.

46. The apparatus of claim 45, wherein said fluid metering means comprises jet means to meter said fluid transfer between said upper and lower chambers, in a first direction, and check valve means to permit free flow of said fluid in a second, opposite direction.

47. The apparatus of claim 46, wherein said fluid metering means further possesses pressure relief means in series with said jet means, said pressure relief means adapted to open in response to a predetermined fluid pressure in one of said chambers.

48. The apparatus of claim 47, wherein said check valve means comprises first and second check valves, said first check valve adapted to prevent fluid bypass of said jet means in said first direction, and said second check valve adapted to prevent fluid bypass of said pressure relief means in said first direction.

* * * * *